US006502554B1

(12) United States Patent
Buehler

(10) Patent No.: US 6,502,554 B1
(45) Date of Patent: Jan. 7, 2003

(54) FUEL INJECTION VALVE FOR INTERNAL COMBUSTION ENGINES

(75) Inventor: Christoph Buehler, Gerlingen (DE)

(73) Assignee: Robert Bosch GmbH, Stuggart (DE)

( * ) Notice: Subject to any disclaimer, the term of this patent is extended or adjusted under 35 U.S.C. 154(b) by 0 days.

(21) Appl. No.: 09/646,189

(22) PCT Filed: Nov. 24, 1999

(86) PCT No.: PCT/DE99/03723

§ 371 (c)(1),
(2), (4) Date: Nov. 3, 2000

(87) PCT Pub. No.: WO00/42316

PCT Pub. Date: Jul. 20, 2000

(30) Foreign Application Priority Data

Jan. 14, 1999 (DE) ..... 199 01 057

(51) Int. Cl.[7] ..... F02M 37/04
(52) U.S. Cl. ..... 123/467; 123/496; 239/533.3
(58) Field of Search ..... 123/467, 470, 123/472, 496; 239/535.1, 533.12, 88–96

(56) References Cited

U.S. PATENT DOCUMENTS 4,767,061 A * 8/1988 Ingemansson ..... 239/566
5,020,500 A * 6/1991 Kelly ..... 123/467
5,159,911 A * 11/1992 Williams et al. ..... 123/467
5,288,025 A * 2/1994 Cerny ..... 239/533.3
5,449,121 A * 9/1995 El-Darazi et al. ..... 239/533.3
5,647,536 A * 7/1997 Yen et al. ..... 239/90
5,711,277 A * 1/1998 Fuseya ..... 123/496
6,145,492 A * 11/2000 Lixl ..... 123/467
6,234,404 B1 * 5/2001 Cooke ..... 239/88

* cited by examiner

*Primary Examiner*—Carl S. Miller
(74) *Attorney, Agent, or Firm*—Ronald E. Greigg

(57) ABSTRACT

A fuel injection valve for internal combustion engines with a valve member that is guided so that the valve member can move axially in a bore of the valve body. The valve member, on an end oriented toward the combustion chamber of the engine, has a conical valve sealing surface with which the valve member cooperates with a conical valve seat surface at the closed, combustion chamber end of the bore of the valve member. The conical valve sealing surface on the valve member is divided into two regions that have different cone angles, at the transition of which a transition region is formed. The transition region is delimited by an upstream and a downstream valve sealing edge, where the difference between the cone angle of the transition region and the cone angle of the valve sealing surface is smaller than the difference between the cone angle of the downstream region and the cone angle of the valve sealing surface (inverse seat angle differential). The transition region is adjoined on the upstream side by a radial recess, which is embodied in the valve member and is delimited by the upstream sealing edge of the transition region and an edge embodied on the valve body.

2 Claims, 2 Drawing Sheets

FUEL INJECTION VALVE FOR INTERNAL COMBUSTION ENGINES

PRIOR ART

The invention relates to a fuel injection valve for internal combustion engines Fuel injection valves of this kind have been disclosed, for example, by DE 195 47 423 A1 and DE 196 34 133 A1.

In fuel injection valves of this kind, a piston-shaped valve member is guided so that the valve member can move axially in a bore of a valve body, On its end oriented toward the combustion chamber, the valve member has a conical valve sealing surface with which it cooperates with a conical valve seat surface on the valve body, the valve seat surface being formed at the inward protruding end of the closed valve bore. The valve sealing surface on the valve member is divided into several, preferably two, regions with different cone angles, and a transition region is provided between the two valve sealing surface regions, which is delimited by a downstream and an upstream valve sealing edge.

Due to the high valve closing forces that occur particularly in these fuel injection valves of the "hole nozzle type", an asymmetrical jet pattern occurs, particularly with very small strokes of the valve member or during the prestroke when there are two spring retainers, and this asymmetrical jet, pattern leads to an increase in emissions of the internal combustion engine. The valve member adapts to the nozzle body elastically as a result of the valve closing force. In this case, the hydraulically effective seat diameter thus produced is indefinitely disposed in the transition range, as schematically depicted in FIG. 1. The inverse seat angle differential produces a pressure distribution on the axially offset valve member, which presses the valve member back into the central, axial position. By contrast, in a fuel injection valve without an inverse seat angle differential, a pressure distribution would be produced which would move the valve member even further away from the central, axial position.

An object of the invention is to modify a fuel injection valve of this generic type in such a way that the axial alignment of the valve member permits the production of a symmetrical jet pattern. The invention also permits the production of a definite hydraulically effective seat diameter, a high degree of damping of the valve member, and the least possible risk of cavitation.

In a fuel injection valve of the type described at the beginning, this object is attained according to the invention and particularly with increasing wear on the fuel injection valve. The fuel invention valve has the advantage that by means of the radial, undercut-shaped recess embodied in the valve member upstream of the transition region and by means of the inverse seat angle differential, the hydraulically effective seat diameter can "travel" maximally to the upstream valve sealing edge. This produces a precisely defined hydraulically effective seat diameter at the upstream valve sealing edge.

The distance between the upstream and downstream valve sealing edges of the transition region is selected so that the upstream valve sealing edge of the transition region constitutes the hydraulically effective seat diameter. The distance can be determined by means of experimental measurements arid/or calculations.

BRIEF DESCRIPTION OF THE DRAWINGS

An exemplary embodiment of the fuel injection valve for internal combustion engines according to the invention is shown in the drawings and will be explained in detail in the subsequent description.

DESCRIPTION OF THE EXEMPLARY EMBODIMENTS

Figure 1:
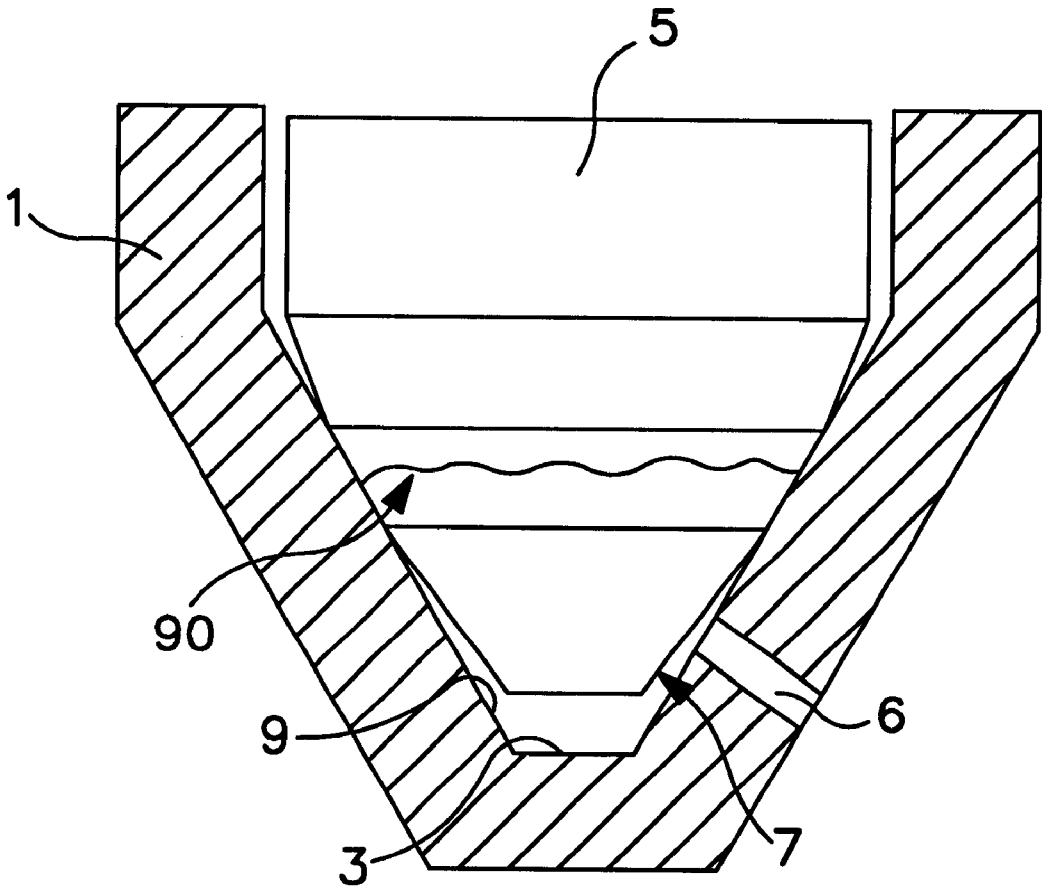
FIG. 1 PRIOR ART
FIG. 1 schematically depicts the hydraulically effective seat diameter in a valve known from the prior art.
Figure 3:
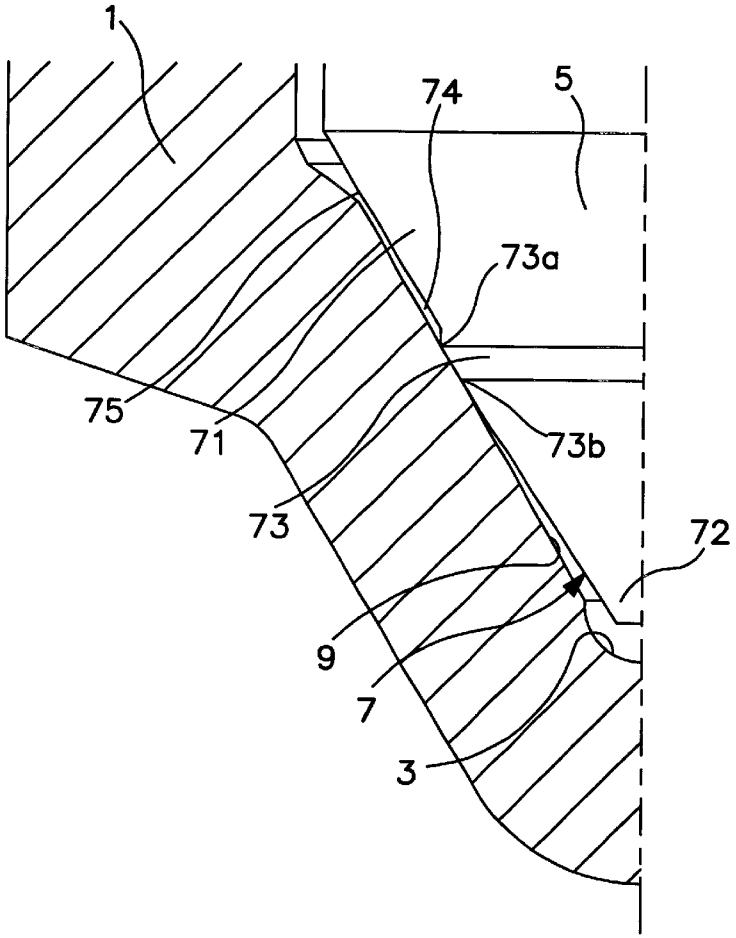
FIG. 3 shows an enlarged detail of the fuel injection valve shown in FIG. 2.
Figure 2:
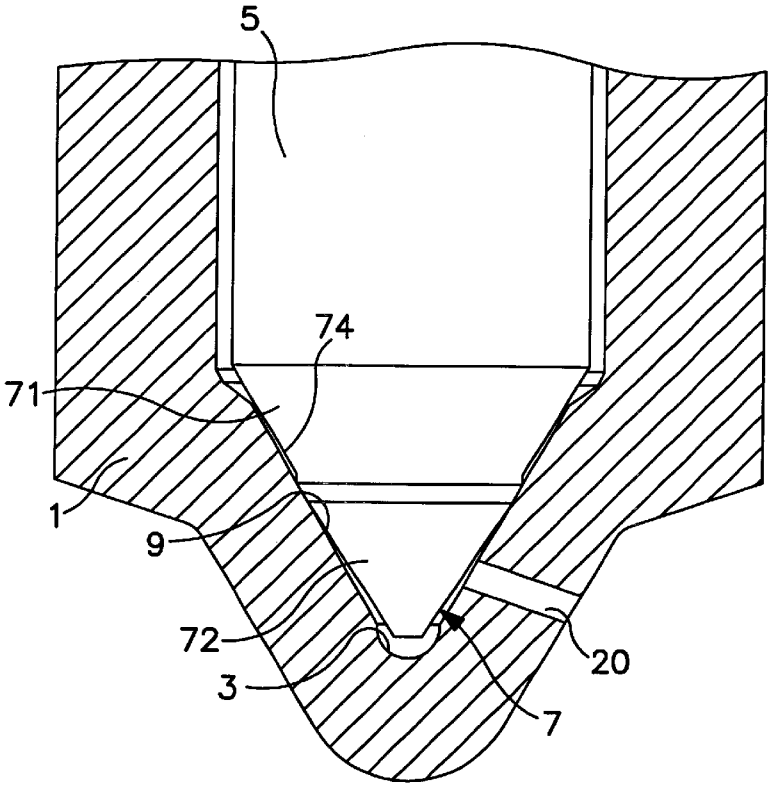
FIG. 2 shows a fuel injection valve used by the invention.

A fuel injection valve for internal combustion engines shown in FIGS. 1 to 3 has a cylindrical valve body 1, which with its free, lower end, protrudes into a combustion chamber, not shown, of the internal combustion engine to be supplied with fuel. An axial blind bore 3 is provided in the valve body 1 and a piston-shaped valve member 5 is guided so that the valve member can move axially in this bore. At its lower end oriented toward the combustion chamber, the valve member 5 has a conical valve sealing surface 7, with which it cooperates with a conical valve seat surface 9 at the combustion chamber end of the valve body 1 in order to control an injection cross section. The valve seat surface is formed at the inward protruding, closed end of the bore 3 and has injection openings 6 leading from the closed end into the combustion chamber of the internal combustion engine. As can be inferred from FIG. 3 in particular, the valve sealing surface 7 is divided into an upper region 71 and a lower region 72. Between the upper region 71 and the lower region 72, there is a transition region 73. The angle that results from the difference between the transition region 73 and the valve seat surface 9 must be smaller than the angle that results from the difference between the valve seat surface 9 and the lower region 72 (inverse seat angle differential). Adjoining the downstream region 72, injection openings 20 are provided in the valve body 1. The upstream region 71 of the valve sealing surface has a radial, undercut-shaped recess 74. This forms a chamber that is defined on the upstream side by an edge 75 that is embodied on the valve body 1. The transition region 73 is delimited by an upstream valve sealing edge 73*a* and a downstream valve sealing edge 73*b*, which are disposed adjacent to each other in such a way that the hydraulically effective seat diameter in a closing process coincides with the upstream valve sealing edge 73*a*. Because of this definite hydraulically effective seat diameter, a resulting radial force on the valve member is prevented, which occurs with the indefinitely extending hydraulically effective seat diameter 90 shown in FIG. 1.

The design of the distance between the two valve sealing edges 73*a* and 73*b* is determined experimentally and on the basis of calculations. With a maximal closing force of 1250 N, which can be determined experimentally, there is for example a diameter difference of approximately 0.15 mm with a geometric seat diameter of 2 mm. With this minimal transition region, i.e. with this minimal seat adaptation surface, it is in any case assured that the hydraulically effective seat diameter precisely coincides with the valve sealing edge 73*a*.

By means of the radial recess 74 in the valve member 5, a damping chamber is produced which permits a very high degree of damping of the valve member 5 during a closing process. In this connection, preferably the angle that encloses the damping chamber is selected so that the angle is greater than the body seat angle. This produces a damping chamber in the closed state, which achieves an effect similar to that of a sail and produces a pressure cushion during the closing of the valve member 5. The pressure cushion increases the damping of the valve member 5. During a closing process of the fuel injection valve, the fuel disposed in the damping chamber is displaced and flows out of the damping chamber through the gap formed at the upstream end between the valve member 5 and the edge 75. The damping effect is produced during the closing process due to the flow resistance produced by the gap. The upstream edge 75 is designed so that in the extreme case, with full deformation of the valve member, there is no distance from this edge to the valve body 5. This damping results in a reduced cone load.

A fuel injection valve of this type also has the advantage that the bubble collapse of cavitation bubbles preferably occurs in the region upstream of the edge 75 since the edge 75 can keep the pressure waves produced by the injection pump away from the transition region. As a result, the seat region is not damaged.

The valve holding body, not shown, has a tendency toward an opening pressure drop, whereas the valve member 5, due to the inverse seat angle differential, has a tendency toward an opening pressure increase. Contrary effects occur which partially cancel each other out. This increases the service life of the fuel injection valve.

The foregoing relates to a preferred exemplary embodiments of the inventions, it being understood that other variants and embodiments thereof are possible within the spirit and scope of the invention, the latter being defined by the appended claims.

I claim:

1. A fuel injection valve for internal combustion engines comprising a valve member (5) that is guided so that the valve member moves axially in a bore (3) of a valve body (1), and the valve member, on an end oriented toward a combustion chamber of the engine, has a conical valve sealing surface (7), the conical valve sealing surface cooperating with a conical valve seat surface (9) at a closed, combustion chamber end of the bore (3) of the valve body (1), the conical valve sealing surface (7) on the valve member (5) is divided into first and second regions (71, 72) that have different cone angles, at the transition of the first and second regions, a transition region (73) is formed, the transition region is delimited by an upstream and a downstream valve sealing edge **(73*a* and 73*b*), where the difference between the cone angle of the transition region (73) and the cone angle of the valve seat surface (9) is smaller than the difference between the cone angle of the downstream region (72) and the cone angle of the valve seat surface (9), the inverse seat angle differential, the transition region (73) adjoined on an upstream side by a radial recess (74), which is embodied in the valve member (5) and is delimited by the upstream sealing edge (73*a*) of the transition region (73) and an edge (75) embodied on the valve body (1)**.

2. The fuel injection valve according to claim 1, in which the upstream and downstream valve sealing edges **(73*a*, 73*b*) delimiting the transition region (73) are disposed close to each other so that the upstream valve sealing edge (73*a*)** constitutes a hydraulically effective seat diameter.

* * * * *